US010358907B2

(12) United States Patent
Toniolo et al.

(10) Patent No.: US 10,358,907 B2
(45) Date of Patent: Jul. 23, 2019

(54) SELF RETRACTING WALL CONTACT WELL LOGGING SENSOR

(71) Applicant: Schlumberger Technology Corporation, Sugar Land, TX (US)

(72) Inventors: Julien Toniolo, Houston, TX (US); Randall Smith, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 70 days.

(21) Appl. No.: 15/488,826

(22) Filed: Apr. 17, 2017

(65) Prior Publication Data

US 2018/0298745 A1 Oct. 18, 2018

(51) Int. Cl.
*E21B 47/01* (2012.01)
*E21B 17/10* (2006.01)

(52) U.S. Cl.
CPC ..... *E21B 47/011* (2013.01); *E21B 17/1028* (2013.01)

(58) Field of Classification Search
CPC ..... E21B 17/1021; E21B 47/011
See application file for complete search history.

(56) References Cited

U.S. PATENT DOCUMENTS 1,893,020 A * 1/1933 Cushing ..... E21B 17/1021 175/325.7
1,898,074 A * 2/1933 Bailey ..... E21B 17/1021 15/104.061
2,346,481 A * 4/1944 Garrison ..... G01V 8/02 250/267
2,736,967 A * 3/1956 Doll ..... E21B 47/082 324/445
2,899,633 A * 8/1959 Smith et al. ..... G01V 11/005 166/66
3,281,599 A * 10/1966 Baker ..... E21B 49/005 250/268
3,555,689 A * 1/1971 Kinley ..... E21B 17/1021 166/241.5
3,631,385 A 12/1971 Silverman et al.
3,685,158 A * 8/1972 Planche ..... E21B 17/1021 33/302
3,795,141 A 3/1974 Planche
(Continued)

FOREIGN PATENT DOCUMENTS

DE 2031664 B * 4/1971
WO WO2011097110 A1 8/2011

OTHER PUBLICATIONS

International Search Report and Written Opinion issued in the related PCT Application PCT/US2018/027859 dated Jul. 17, 2018 (15 pages).

*Primary Examiner* — John Fitzgerald
(74) *Attorney, Agent, or Firm* — Eileen Pape

(57) ABSTRACT

A wellbore wall contact measuring instrument includes an instrument housing configured to move along an interior of a wellbore. A wall contact sensor arm is connected to the housing through a first biasing device to urge the wall contact sensor arm outwardly from the instrument housing. A second biasing device is coupled between the instrument housing and the sensor arm. A wall contact well logging sensor is disposed at an end of the wall contact sensor arm.

17 Claims, 4 Drawing Sheets

(56) References Cited

U.S. PATENT DOCUMENTS 3,978,924 A * 9/1976 Roesner ..... E21B 17/1021 166/241.5
4,243,099 A 1/1981 Rodgers, Jr.
4,523,640 A * 6/1985 Wilson ..... E21B 36/00 166/241.5
4,545,242 A 10/1985 Chan
4,557,327 A * 12/1985 Kinley ..... E21B 17/1021 166/172
4,588,951 A * 5/1986 Ohmer ..... E21B 17/1021 250/268
4,595,055 A * 6/1986 Vannier ..... E21B 17/1021 166/241.5
4,776,397 A * 10/1988 Akkerman ..... E21B 17/1021 166/241.5
5,019,978 A 5/1991 Howard, Jr. et al.
5,022,484 A * 6/1991 Panetta ..... E21B 17/1021 181/102
5,086,645 A * 2/1992 Deaton ..... E21B 47/08 417/226
5,198,770 A * 3/1993 Decorps ..... G01V 11/002 181/102
5,353,873 A * 10/1994 Cooke, Jr. ..... E21B 47/065 166/64
5,355,950 A 10/1994 Zwart
5,358,039 A * 10/1994 Fordham ..... E21B 17/1021 166/172
5,541,587 A 7/1996 Priest
6,154,704 A 11/2000 Jericevic et al.
6,256,587 B1 7/2001 Jericevic et al.
6,736,210 B2 5/2004 Hosie et al.
7,069,775 B2 * 7/2006 Fredette ..... E21B 47/082 73/152.17
7,516,782 B2 * 4/2009 Sheiretov ..... E21B 4/18 166/206
7,854,258 B2 * 12/2010 Sheiretov ..... E21B 4/18 166/98
8,464,791 B2 * 6/2013 Jacob ..... E21B 17/1021 166/254.2
9,181,796 B2 11/2015 Malone et al.
10,030,505 B1 7/2018 Toniolo
2002/0032529 A1 3/2002 Duhon
2004/0118611 A1 6/2004 Runia et al.
2006/0047430 A1 3/2006 Edwards
2006/0071663 A1 4/2006 Stanley et al.
2008/0156477 A1 * 7/2008 Aivalis ..... E21B 23/00 166/53
2010/0163251 A1 7/2010 Mock et al.
2010/0300685 A1 12/2010 Del Campo et al.
2012/0048541 A1 * 3/2012 Jacob ..... E21B 17/1021 166/254.2
2012/0055711 A1 * 3/2012 Brannigan ..... E21B 47/08 175/50
2012/0186874 A1 * 7/2012 Malone ..... E21B 47/01 175/45
2013/0068479 A1 * 3/2013 Aldossary ..... E21B 23/14 166/381
2014/0174733 A1 6/2014 Gadot et al.
2015/0034336 A1 * 2/2015 Morrison ..... E21B 17/1028 166/381
2016/0032711 A1 * 2/2016 Sheiretov ..... E21B 47/09 73/152.54
2017/0115420 A1 4/2017 Cazeneuve et al.

* cited by examiner

SELF RETRACTING WALL CONTACT WELL LOGGING SENSOR

CROSS REFERENCE TO RELATED APPLICATIONS

Not Applicable.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of well logging instruments. More specifically, the disclosure relates to well logging instruments having sensors disposed in a pad or arm extending laterally from the instrument housing to make contact with the wall of a wellbore or the interior of a pipe, casing or tubing.

Oil and gas exploration and production uses certain types of instruments or tools lowered into wells drilled through subsurface formations. Such instruments may be lowered into and withdrawn from a well through a conduit such as drill pipe, tubing and casing.

Among these tools, certain types of such well logging tools require having sensors applied against the borehole wall (or the inner wall of, e.g., a casing) to obtain good quality measurements. Such sensors may be referred to as "wall contact" sensors.

Wall contact sensors, for example and without limitation, micro-resistivity, dielectric, ultrasonic, wheel and nuclear sensor are often fragile and it is important to protect the sensors during conveyance through a wellbore, in particular one of the above mentioned types of pipe, to avoid their destruction or their unnecessary wear.

Wall contact sensors are typically spring loaded and have an active (power operated) retraction system. The retraction system may comprise hydraulic pumps and motors, or electric motors, making them complex assemblies.

DETAILED DESCRIPTION

Figure 1:
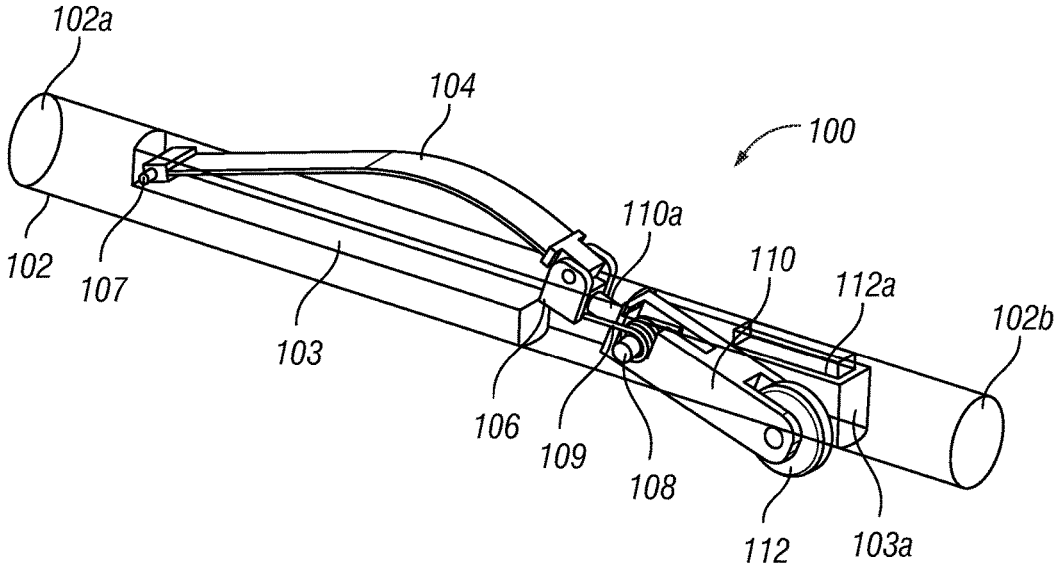
FIG. 1 shows an oblique view of an example embodiment of a self-retracting wall contact sensor according to the present disclosure.
Figure 1A:
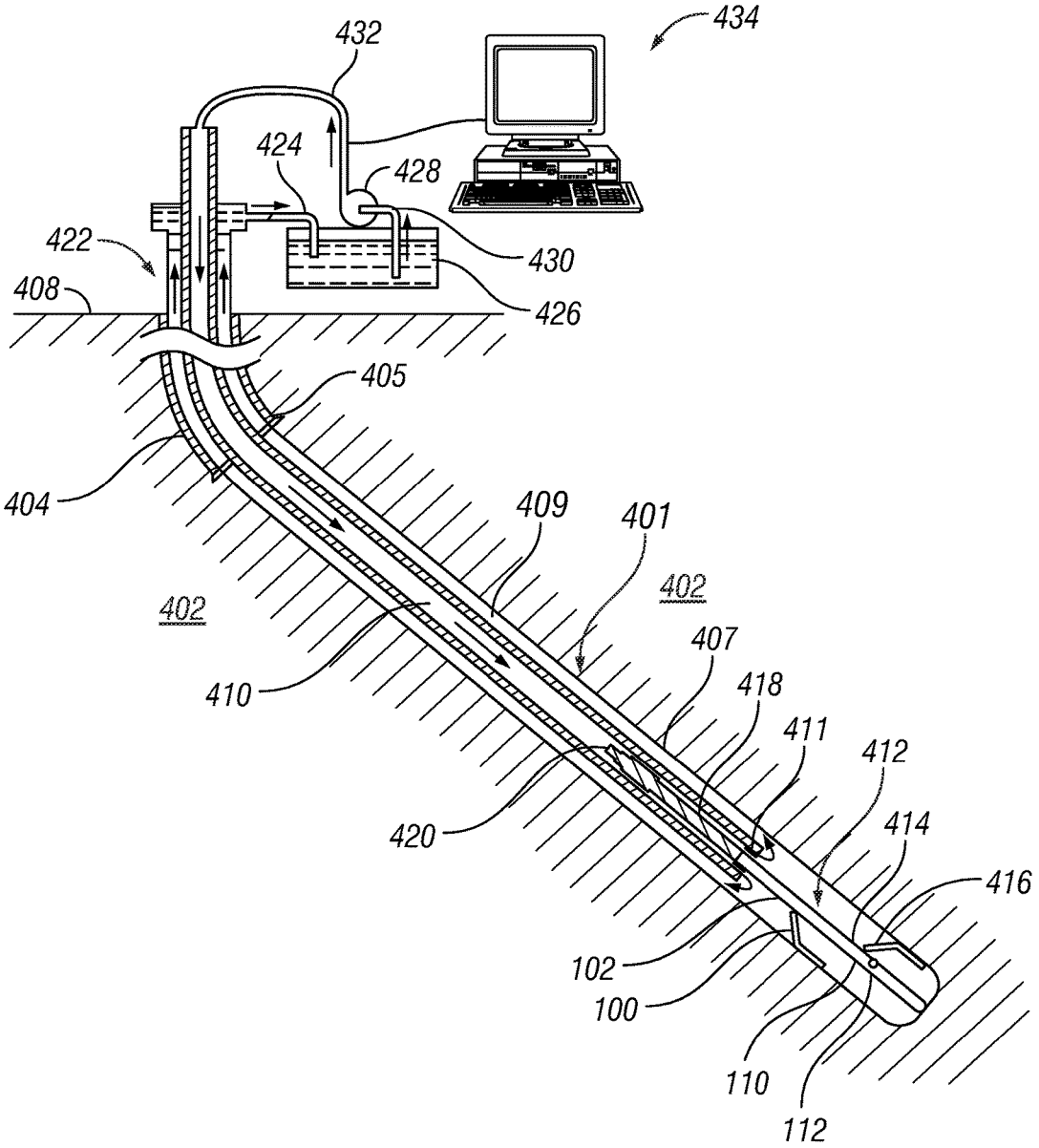
FIG. 1A shows an example embodiment of a self retracting wall contact sensor being moved into a wellbore through a drill pipe.

FIG. 1A shows a non-limiting example embodiment of using a wall contacting well logging instrument where the wall contact well logging instrument is lowered into a wellbore through a drill pipe and is then extended into open (uncased) wellbore below the bottom of the drill pipe. The wellbore 401 is formed in an underground formation 402. The wellbore 401 may be filled with, e.g., drilling fluid. The wellbore 401 may have an upper portion provided with a casing 404 extending from a drilling rig (not shown) at the Earth's surface 408 into the wellbore 401 to a casing shoe 405, and an open lower portion 407 extending below the casing shoe 405. A conduit, which in the present embodiment may be a tubular drill pipe 409 containing a body of drilling fluid 410 and having an open lower end 411, extends from the drilling rig (not shown) into the wellbore 401 whereby the open lower end 411 is disposed in the open lower wellbore portion 407. A first well logging instrument 412 capable of being lowered or raised through the drill pipe 409, is retrievably suspended in the drill pipe 409 by a deployment device (not shown separately). The well logging instrument 412 may include one or more types of wall contact well logging sensors, including, for example and without limitation, a formation imaging sensor, a microresistivity sensor, a dielectric sensor, a nuclear sensor or a nuclear magnetic resonance sensor. A first such wall contact sensor is shown at 414 as having a self retracting arm 416. The first well logging instrument 412 may include a fluid pressure pulse device 418 arranged at the upper end of the first wall contact sensor 414, whereby the first wall contact sensor 414 extends below the lower end part 411 of the drill pipe 409 and the pressure pulse device 418 is disposed within the drill pipe 409. The well logging instrument 412 may be powered by a battery (not shown) and can be provided with an electronic memory (not shown) or other recording medium for storing measurement data.

It is within the scope of this disclosure that any known wall contact well logging sensor or instrument that can be moved through the inside of a tube or conduit may be used with a deployment device according to the present disclosure. Such sensors and/or instruments include, without limitation, acoustic sensors, electromagnetic resistivity sensors, galvanic resistivity sensors, seismic sensors, Compton-scatter gamma-gamma density sensors, neutron capture cross section sensors, neuron slowing down length sensors, calipers, gravity sensors and the like.

The fluid pressure pulse device 418 has a variable flow restriction (not show) which is controlled by electric signals transmitted by the imaging tool 414 to the pressure pulse device 418, which signals represent part of the data produced by the first well logging instrument 412 during the making of measurements of the underground formation 2. The upper end of the deployment device may be provided with a latch 420 for latching of an armored electrical cable (not shown) to the device for retrieval of the first well logging instrument 412 from the bottom of the drill pipe 409.

A wellhead 422 may be connected to the upper end of the casing 404 and may be provided with an outlet conduit 424 terminating in a drilling fluid reservoir 426 provided with a suitable sieve means (not shown) for removing drill cuttings from the drilling fluid. A pump 428 having an inlet 430 and an outlet 432 is arranged to pump drilling fluid from the fluid reservoir 426 into the upper end of the drill pipe 409.

A control system 434 located at the Earth's surface is connected to the drill pipe 409 for sending or receiving fluid pressure pulses in the body of drilling fluid 410 to or from the fluid pressure pulse device 418.

A second wall contact well logging instrument 100 with a self retracting sensor arm 110 and a sensing element 112 disposed at the end of the self retracting sensor arm 110 may disposed in and extend from a housing 100 coupled within or at an end of a set of well logging instruments. This instrument 100 will be identified as the "self retracting wall contact instrument."

The embodiment of the set of devices shown in FIG. 1A may be used, for example in "through the drill bit" well logging operations, for example and without limitation as described in U.S. Patent Application Publication No. 2004/0118611 filed by Runia et al.

In the description that follows with reference to FIGS. 1 through 6, like components will be identified by like reference numerals. FIG. 1 shows an oblique view of the self retracting wall contact instrument 100 in more detail. The functional components of the self retracting wall contact instrument 100 include a housing 102 that may be coupled at each longitudinal end 102A, 102B to another well logging instrument, a cable head, a bullnose or any other device known to be connected to a longitudinal end of a well logging instrument housing.

The housing 102 may comprise open compartments 103, 103A, respectively for receiving a first passive biasing device 104 such as an arched spring and for receiving a sensor arm 110. The arched spring 104 and the sensor arm 110 may extend laterally outward from the housing 102 in opposed directions. In the present context, "passive" means, with reference to a biasing device, that no power operated elements are used to operate the passive biasing device. In the case of an arched spring as the first passive biasing device 104, one end of the arched spring may be attached to the housing 102, in some embodiments in a longitudinally fixed position, by a pivot pin 107. The other end of the ached spring 104 may be attached to a coupling 106 that slidably engages an extension 110A of the sensor arm 110.

The sensor arm 110 may be pivotably coupled to the housing 102 by a pivot rod 108. A second passive biasing device 109 such as a torsion spring may be fitted over one or both longitudinal ends of the pivot rod 108 (that extend outwardly from the sensor arm 110) to apply a torque to the sensor arm 110 such that the sensor arm 110 is urged laterally outward from the compartment 103A in the housing 102. A wall contact sensor 112 may be affixed to the end of the sensor arm 110 opposed to the extension 110A. In the present example embodiment, the wall contact sensor 112 may be a wheel used to make measurement corresponding to amount of motion of the well logging instruments (FIG. 1A) along the wall of a wellbore or wellbore tubular component. As explained with reference to FIG. 1A, the wall contact sensor 112 may be any other type of well logging sensor requiring contact with the wall of the wellbore or wellbore tubular component. In the case of a wheel sensor, the wheel may comprise integral magnets (not shown separately) and a sensing coil or magnetometer 112A may be fixed to the compartment 103A such that rotation of the wheel induces signal pulses in the sensing coil or magnetometer 112A. Other possible, but non limiting examples of embodiments of the wall contact sensor 112 have been explained above with reference to FIG. 1A.

Figure 2:
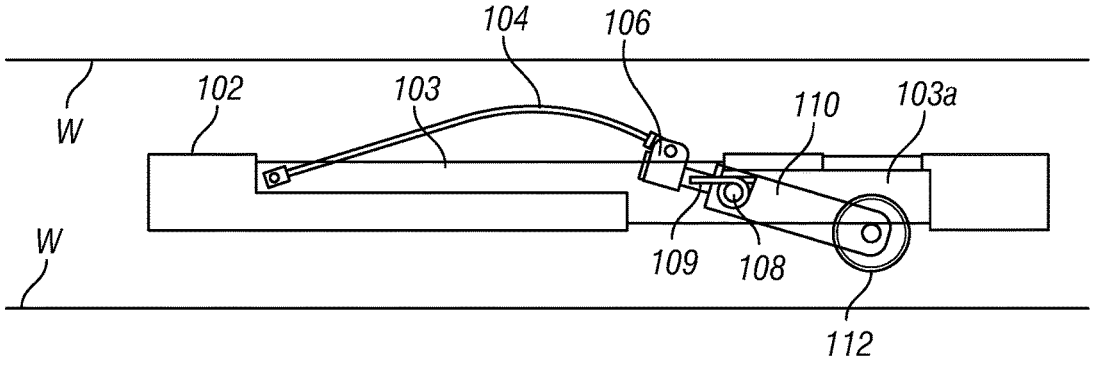
FIG. 2 shows the wall contact sensor of FIG. 1 disposed in a pipe having a larger internal diameter than the unconstrained diameter of the wall contact sensor.

FIG. 2 shows the wall contact instrument 100 wherein there is no contact between the wall contact instrument 100 and the interior of the wellbore. The wall of the wellbore is identified by W in FIG. 2. In such condition, the arched spring 104 is fully outwardly extended such that the slidable coupling 106 is retracted along the sensor arm extension 110A. Thus, the sensor arm 110 may be fully extended from the housing 102 by the torque applied by the torsion spring 109. There is no contact between the sensor 112 and the wellbore W in FIG. 2.

Figure 3:
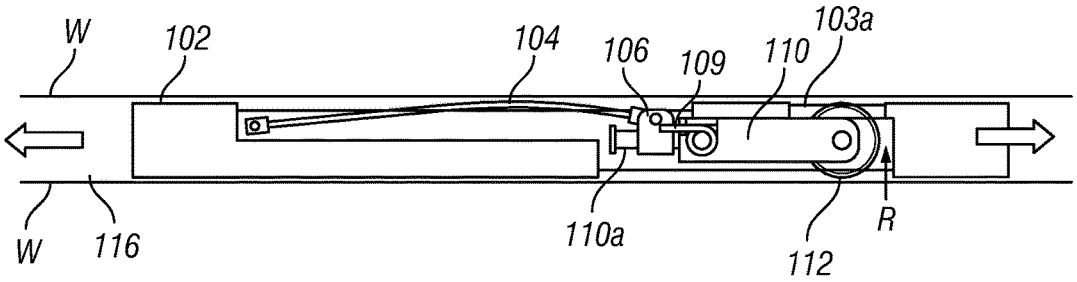
FIG. 3 shows the wall contact sensor of FIG. 1 moving through a conduit having a minimum pass through diameter of the wall contact sensor.

FIG. 3 shows the wall contact sensor 100 disposed inside a pipe or conduit 116 having diameter between opposed sides of the wall W thereof that is just large enough to enable passage therethrough of the wall contact sensor 100. For example and without limitation such wall W may be in a drill pipe, tubing or casing. In FIG. 3, the arched spring 104 is fully laterally compressed. Compression of the arched spring results in a radial inwards force being applied by the slidable coupling 106 onto the sensor arm 110. Urging the slidable coupling 106 against the sensor arm 110 results in a torque applied to the sensor arm 110 in a direction opposed to the torque applied by the torsion spring 109. The sensor arm 110 and the wall contact sensor 112 are thereby retracted as shown at R into the compartment 103A in the housing 102. In such circumstances, there is essentially no contact between the wall W and the wall contact sensor 112. Thus the wall contact instrument 100 may be moved through the interior of the conduit 116 without any contact between the wall W thereof and the wall contact sensor 112. Thus, damage to the wall contact sensor 112 during such movement may be avoided or the risk thereof may be reduced.

Figure 4:
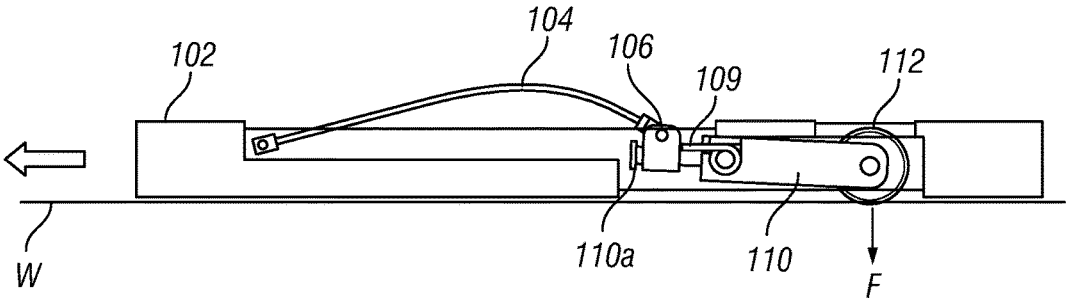
FIG. 4 shows the wall contact sensor of FIG. 1 moving along a bottom side of a wellbore wherein a wall contact sensor biasing device is fully laterally expanded.

FIG. 4 shows an example of the wall contact well logging instrument 100 being moved along the interior of a wellbore W wherein the internal diameter thereof is large enough so that the arched spring 104 is at least partially extended from the fully compressed state shown in FIG. 3. When the arched spring 104 is at least partially extended, there is insufficient radial inwards force is transmitted to the sensor arm to cause the sensor arm 110 to retract. In such condition, the torsion spring 109 exerts sufficient torque on the sensor arm 110 such that the wall contact sensor 112 is urged into contact with the interior of the wellbore W with a predetermined force F.

Figure 5:
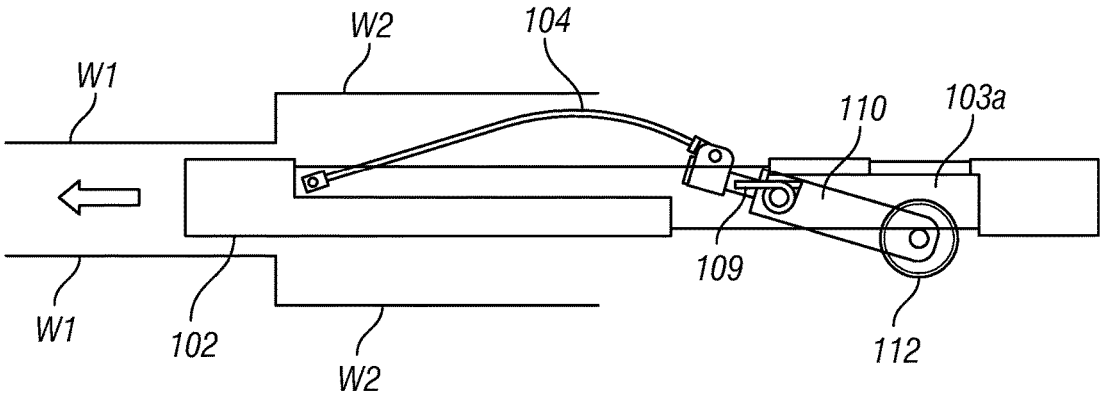
FIG. 5 shows the wall contact sensor of FIG. 1 moving from a larger internal diameter passage, such as an uncased wellbore into a smaller diameter passage such as a drill pipe, casing or tubing.
Figure 6:
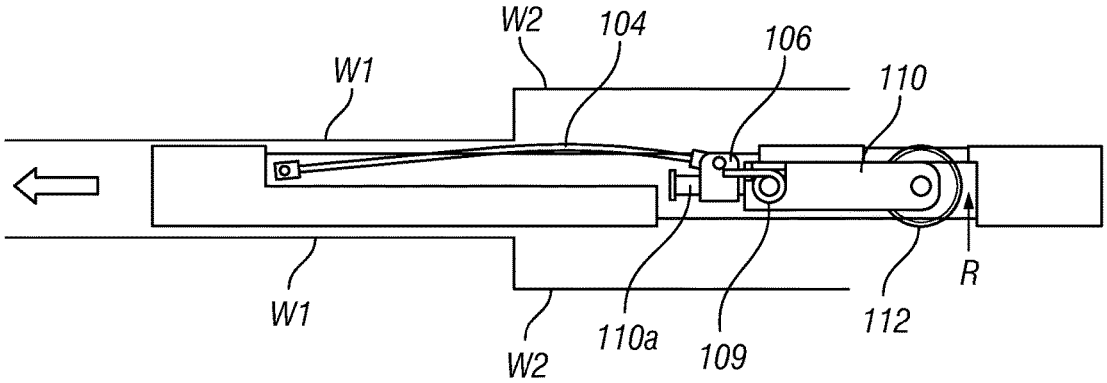
FIG. 6 shows the wall contact sensor of FIG. 5 partially disposed within the smaller diameter passage to illustrate operation of a self retracting mechanism associated with a wall contact sensor arm.

FIG. 5 and FIG. 6 show the wall contact instrument 100 moving from a larger diameter opening W2 such as an uncased wellbore into a smaller diameter opening W1 such as a wellbore tubing or a drill pipe, or from a wellbore through an opening in a specialized form of drill bit described in U.S. Patent Application Publication No. 2004/0118611 filed by Runia et al. to illustrate how the self retracting mechanism operates to protect the wall contact sensor 112. In FIG. 5, the wall contact instrument 100 is fully disposed in a larger diameter opening W2 wherein the arched spring 104 is at least partially extended, and thus the sensor arm 110 and the wall contact sensor 112 are urged outwardly by the torsion spring 109. Only the very top portion of the wall contact instrument 100 is shown entering the smaller diameter opening W1. The wall contact instrument 100 is moving as indicated by the left-pointing arrow.

In FIG. 6, as the wall contact instrument 100 moves into the smaller diameter opening W1 such that arched spring 104 is compressed, such compression causes the slidable coupling 106 to exert radial inwards force on the sensor arm 110 as explained with reference to FIG. 3, thereby retracting the sensor arm 110 to the opening 103A in the housing 102. The wall contact sensor 112 is correspondingly fully retracted into the opening 103A in the housing 102. What may be observed in FIG. 6 is that the sensor arm 110 is fully retracted into the housing 102 before the sensor arm 110 and wall contact sensor 112 reach the smaller diameter opening W1. Thus, possible damage to the sensor arm 110 and wall contact sensor 112 may be avoided.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A wellbore wall contact measuring instrument, comprising:

an instrument housing configured to move along an interior of a wellbore;

a wall contact sensor arm connected to the housing through a first biasing device to urge the wall contact sensor arm outwardly from the instrument housing;

a second biasing device coupled to the instrument housing at one end and connected to the sensor arm at a second end; and a wall contact well logging sensor disposed at an end of the wall contact sensor arm;

wherein the sensor arm is coupled to the second end such that compression of the second biasing device results in lateral retraction of the sensor arm.

2. The instrument of claim 1 wherein the wall contact well logging sensor comprises a sensor wheel.

3. The instrument of claim 1 wherein the wall contact well logging sensor comprises a sensor conveyed through a drill pipe.

4. The instrument of claim 1 wherein the second biasing device comprises an arched bowspring.

5. The instrument of claim 4 wherein a coupling between the second end of the arched bowspring is slidable along the extension.

6. The instrument of claim 4 wherein the arched bowspring is connected to the sensor arm such that compression of the arched bowspring to a selected diameter results in retraction of the sensor arm and the wall contact sensor to fit entirely within an envelope of the instrument housing.

7. The instrument of claim 4 wherein the sensor arm comprises an extension at one end.

8. The instrument of claim 7 wherein the sensor arm is pivotally connected to the instrument housing, and wherein the first biasing device is arranged to urge the sensor arm outwardly from the instrument housing.

9. The instrument of claim 8 wherein the first biasing device comprises a torsion spring.

10. The instrument of claim 8 wherein the second biasing device comprises a bow spring.

11. The instrument of claim 8 wherein the first biasing device comprises a coiled spring.

12. A method for well logging, comprising:

moving a well logging instrument along an interior of a wellbore, the interior of the wellbore having a first internal diameter, the well logging instrument comprising an instrument housing configured to move along an interior of a wellbore, the well logging instrument comprising a wall contact sensor arm connected to the housing through a first biasing device to urge the wall contact sensor arm outwardly from the instrument housing, the well logging instrument comprising a second biasing device coupled between the instrument housing and the sensor arm, the well logging instrument comprising a wall contact well logging sensor disposed at an end of the wall contact sensor arm;

recording measurements made by the wall contact logging sensor as the wall contact sensor is moved along the interior of the wellbore; and moving the well logging instrument into an opening having a smaller internal diameter than the wellbore, whereby the second biasing device is compressed so as to withdraw the sensor arm inside the housing prior to the sensor arm entering the smaller internal diameter opening.

13. The method of claim 12 wherein the first biasing device comprises a torsion spring.

14. The method of claim 12 wherein the second biasing device comprises an arched spring.

15. The method of claim 12 wherein the wall contact sensor comprises a wheel.

16. The method of claim 12 wherein the smaller internal diameter opening comprises a drill pipe.

17. The method of claim 16 further comprising: conveying the well logging instrument into the wellbore when the well logging instrument is fully disposed inside the drill pipe; extending the well logging instrument out of the drill pipe through a bottom end of the drill pipe; and withdrawing the well logging instrument into the drill pipe after making measurements along a selected length of the wellbore.

* * * * *